US005129609A

United States Patent [19]

Tobin

[11] Patent Number: 5,129,609

[45] Date of Patent: Jul. 14, 1992

[54] FLEXIBLE TRASH BAG SUPPORT APPARATUS

[76] Inventor: Brian E. Tobin, 1021 North 76th St., Omaha, Nebr. 68114

[21] Appl. No.: 704,784

[22] Filed: May 23, 1991

Related U.S. Application Data

[63] Continuation-in-part of Ser. No. 563,570, Aug. 6, 1990, abandoned.

[51] Int. Cl.[5] ..... A63B 55/04

[52] U.S. Cl. ..... 248/97; 220/403; 248/99; 248/152; 248/174

[58] Field of Search ..... 248/97, 95, 99, 100, 248/101, 174152, 205.2, 907; 220/908, 404, 403; 141/314, 391; 211/88

[56] References Cited

U.S. PATENT DOCUMENTS

| | | | |
|---|---|---|---|
| 3,936,087 | 2/1976 | Alexander | 248/99 X |
| 3,977,450 | 8/1976 | Schampier | 220/404 |
| 4,349,123 | 9/1982 | Yang | 220/908 X |
| 4,628,007 | 12/1986 | Ledsham | 220/908 X |
| 4,657,176 | 4/1987 | Matsubara | 220/980 X |
| 4,664,348 | 5/1987 | Corsault, III et al. | 248/99 |
| 4,669,689 | 6/1987 | Jones | 348/152 |
| 4,697,771 | 10/1987 | Majors | 248/152 X |
| 4,749,011 | 6/1988 | Rylander | 248/99 X |
| 4,759,520 | 7/1988 | Levine | 248/174 |
| 4,760,982 | 8/1988 | Cooke | 248/99 |
| 4,890,652 | 1/1990 | Hoerner | 141/391 X |
| 4,979,547 | 12/1990 | Hoerner | 248/95 X |

*Primary Examiner*—Ramon O. Ramirez
*Attorney, Agent, or Firm*—John A. Beehner

[57] ABSTRACT

A flexible trash bag support apparatus adapted for use with conventional trash bags. The apparatus includes a substantially rigid flat back, two foldably connected side members, and trash bag holding slots which can secure trash bags in the desired position. The back may include an extension rendering it taller than the two side members so as to serve as a backboard for allowing refuse thrown at the bag to be deflected thereinto. Additionally, the surfaces of the back and side members may be coated with a conventional; waterproof substance to protect them from damage and increase the life span of the apparatus. The apparatus as thus described is a safe and efficient method of supporting trash bags, and is novel in its method and apparatus for achieving this result.

23 Claims, 9 Drawing Sheets

FLEXIBLE TRASH BAG SUPPORT APPARATUS

CROSS REFERENCE TO RELATED APPLICATION

This patent application is a continuation-in-part of U.S. patent application Ser. No. 563,570, filed on Aug. 6, 1990, now abandoned.

BACKGROUND OF THE INVENTION

The present invention is directed generally toward flexible plastic trash bags and their receptacles and more particularly to a method and apparatus for supporting conventional trash bags for refuse reception.

Plastic trash bags and their receptacles are available in many different sizes and shapes and are well known in the art. The uses of such bags are numerous, including but not limited to trash, leaves and grass clippings.

Although the uses of the plastic trash bag are practically without end, one drawback is the bag's inability to stand upright on its own as a result of its pliability. Consequently, it is frequently desirable to place the bag into some type of sturdy receptacle prior to placing refuse into the bag. The primary reason is to eliminate the need for a person to hold the bag upright while at the same time trying to place the refuse therein. This simultaneous holding of the bag while dumping refuse is especially difficult when the refuse is to be transferred from another receptacle, such as a lawn mower grass catcher, into the bag. Additionally, the receptacle prevents the bag from tipping over and its contents spilling out while the person is away from the bag.

Commonly used receptacles are the hard plastic and metal "garbage cans". The standard procedure is to locate the "garbage can" and the plastic bags, remove a single bag from the container, and then open the bag, usually by attempting to force air into the bag. The bag is then inserted into the can and secured in place by folding the bag over the "lip" of the can. The bag is then ready to be loaded with trash.

The plastic or metal cans are very effective at providing needed support for the plastic bag. However, their design, which is responsible for their success at providing rigidity, is also responsible for one of their major drawbacks, namely that they can not be collapsed into a smaller size. Consequently, they take up space in the garage even when they are not being used, space which is at an extreme premium in most household garages. There are also plastic "rolled up" bag liners on the market which will support trash bags by being inserted and "unrolled." Similarly, these devices take up space when not in use since they are stored in a "rolled up" condition. Accordingly, it is a primary object of the present invention to provide an apparatus, which is capable of supporting plastic trash liner bags for receiving refuse, and yet may be folded flat so as to save space when not in use.

Another disadvantage with presently available receptacles is the difficulty in removing the bag from the receptacle once the bag has been filled, due to the partial vacuum created as the bag is removed. Accordingly, it is an additional objective of the present invention to provide a support apparatus which does not create a partial vacuum when it is removed from the bag.

Another disadvantage of the prior art is that it does not address one of the primary concerns in trash disposal today, that of recycling. Today's trash often is to be sorted into different types such as plastics, paper, cans and metal, etc. The old way to do this was to throw all the trash into one container and then sort it later. This method proved to be inefficient and messy, besides. The present invention avoids these problems by allowing a plurality of bags to be held in close proximity to each other, so that trash may be easily sorted, and such that the bags are held in a much more stable fashion than achieved by the prior art.

Another object of the present invention is to provide a support means which is inexpensive. This is accomplished through the use of inexpensive materials and ease of construction.

Another object of the present invention is to provide a support means which is easy to use.

Another object of the present invention is to provide an inexpensive but prominent advertising medium.

Another object of the present invention is to provide an item which can be used as an inexpensive but useful promotional item.

Another object of the present invention is to allow a plurality of support devices to be connected and held in adjoining relation to allow for easier sorting of garbage as in accordance with many of the current recycling programs.

SUMMARY OF THE INVENTION

The present invention teaches both a novel trash bag support apparatus and a novel method for supporting plastic trash bags for refuse reception. The trash bag support apparatus is adapted to be inserted and expanded inside a conventional plastic trash bag. The apparatus includes a substantially rigid flat back and two foldably connected side members. Also included are plastic bag holding slots into and through which a part of the trash bag can be slid, thus holding the trash bag up. The back may include an extension rendering it taller than the two side members so as to serve as a back board for allowing refuse thrown at the bag to be deflected into the bag. Additionally, the surfaces of the back and side members may be coated with a conventional waterproof substance to protect them from damage.

The method for supporting plastic trash bags for refuse reception includes the steps (1) providing a trash bag and the support apparatus of the invention; (2) opening the trash bag; (3) inserting the support apparatus into the bag; (4) expanding the support apparatus by pivoting outward the side members; and (5) sliding parts of the upper section of the trash bag into separate slots, thus holding the trash bag in the intended open position. The bag may then be filled with refuse. After the bag has been filled, the support apparatus is removed by lifting it upward and out of the bag which is then closed by means of a "twist tie" or other conventional means.

DESCRIPTION OF THE PREFERRED EMBODIMENT

Figure 1:
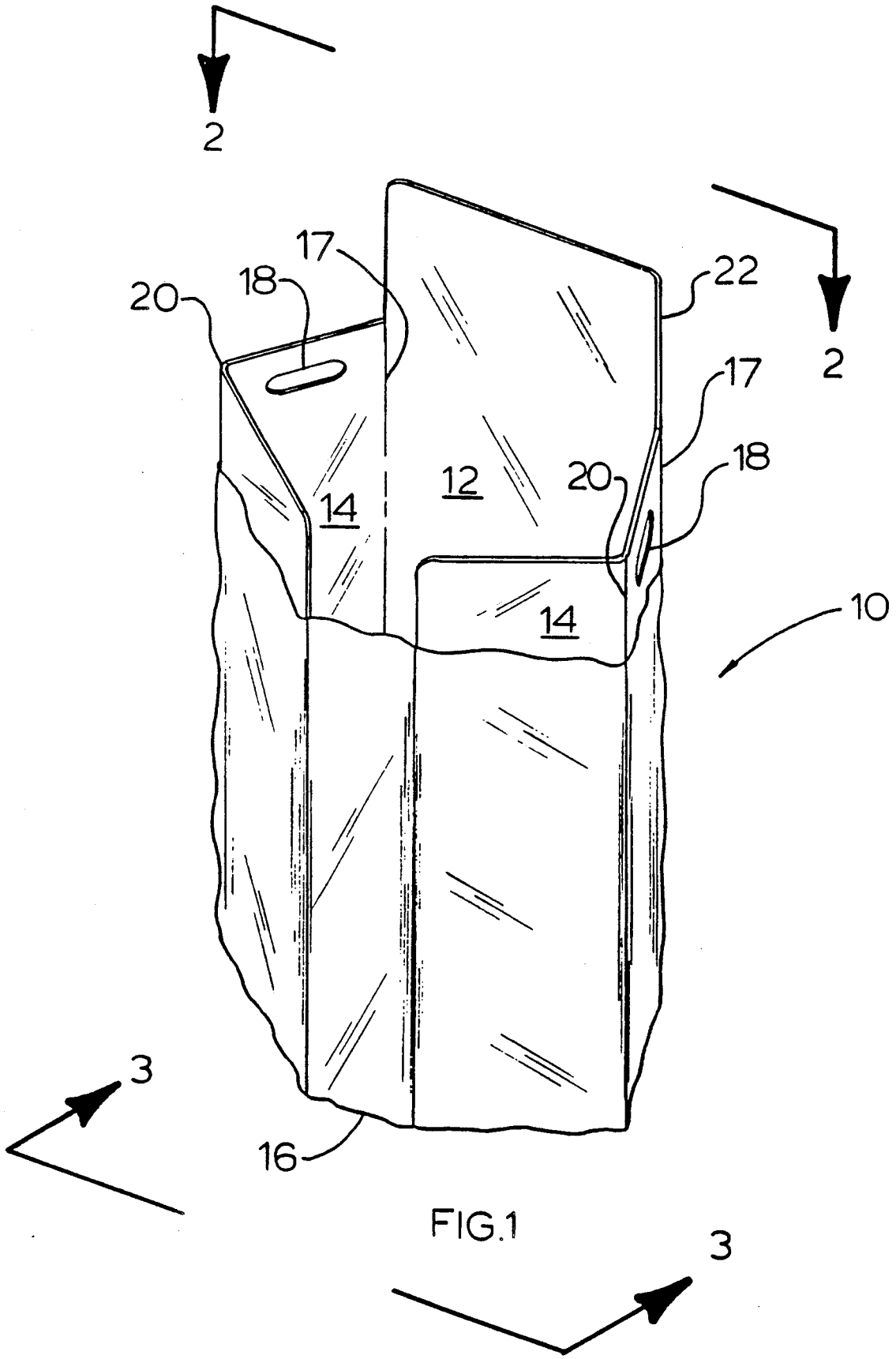
FIG. 1 is a perspective view of the preferred embodiment of the bag support apparatus illustrating its use in providing support for plastic trash bags.

As shown by FIG. 1 which illustrates a first embodiment only, the bag support apparatus 10 has a substantially rigid flat back 12 and two foldably attached side members 14 which when inserted into a plastic bag 16 and pivoted outward from the back will contact the walls of the bag 16 causing it to remain in an upright extended position as shown in FIG. 1. Substantially rigid for these purposes means the ability of the material to be self standing. Thus, the back 12 and side members 14 provide not only support for the bag, but also protection from the refuse thrown therein.

The perforated cut lines 17 between back 12 and side members 14 are preferably perforations in the material of apparatus 10. For a corrugated cardboard apparatus, perforated lines are preferably interspaced cuts, resembling dashes.

Figure 2:
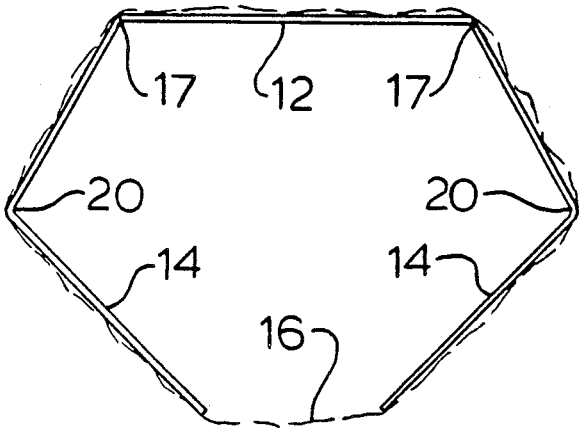
FIG. 2 is a top view of the preferred embodiment of the bag support apparatus illustrating a fully expanded apparatus inside a trash bag.

As shown in FIGS. 1 and 2, the two side members 14 contain one perforated line 20 on each member. The perforated lines 20 cause the plastic bag 16 to assume a substantially rectangular box shape when the apparatus 10 is inserted into the bag 16 and the side members 14 are pivoted outward from the back 12. Although only one perforated line on each side member is shown, it will be understood that there could be a plurality of such lines of perforations on each side member. It will also be noted that each side member 14 has a width less than the back 12, allowing the side members 14 to be folded onto the back 12 so that the apparatus is flat when not in use.

Figure 3:
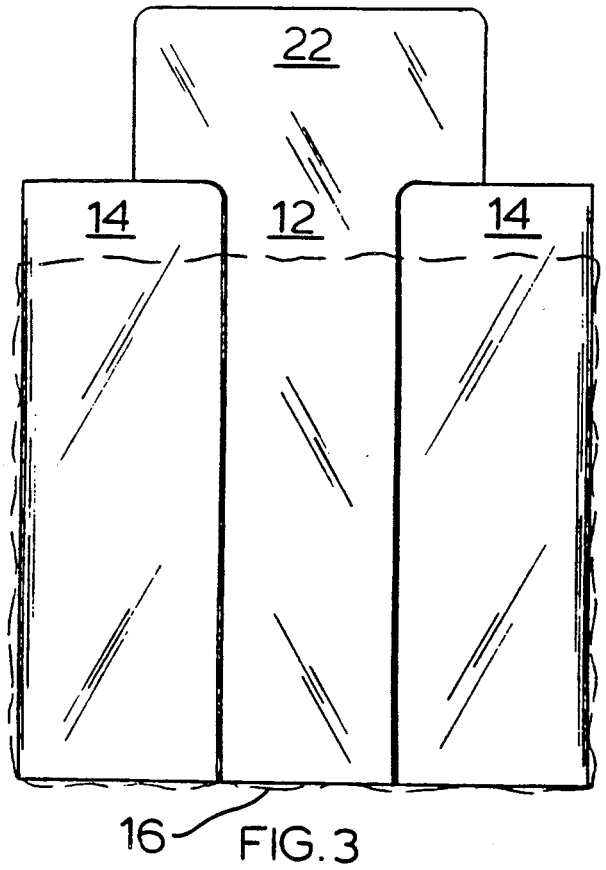
FIG. 3 is a front view showing the support apparatus inserted and expended in a plastic trash bag shown in the dotted lines.

As is shown in FIG. 3, the support apparatus 10 in the preferred embodiment, includes a "backboard" 22 which is part of the back 12 and extends above the height of the side members 14. The backboard 22 aids in the reception of refuse by providing an obstacle to refuse thrown at the support apparatus 10, tending to deflect such refuse into the bag 16, shown as a dotted line in the figure.

Once the bag 16 has been substantially filled with refuse, the support apparatus 10 is easily removed from the bag 16 by grasping the handles 18 (FIG. 1) located on each side member 14 and pulling upward. The bag 16 is then closed using conventional tying means.

Figure 4:
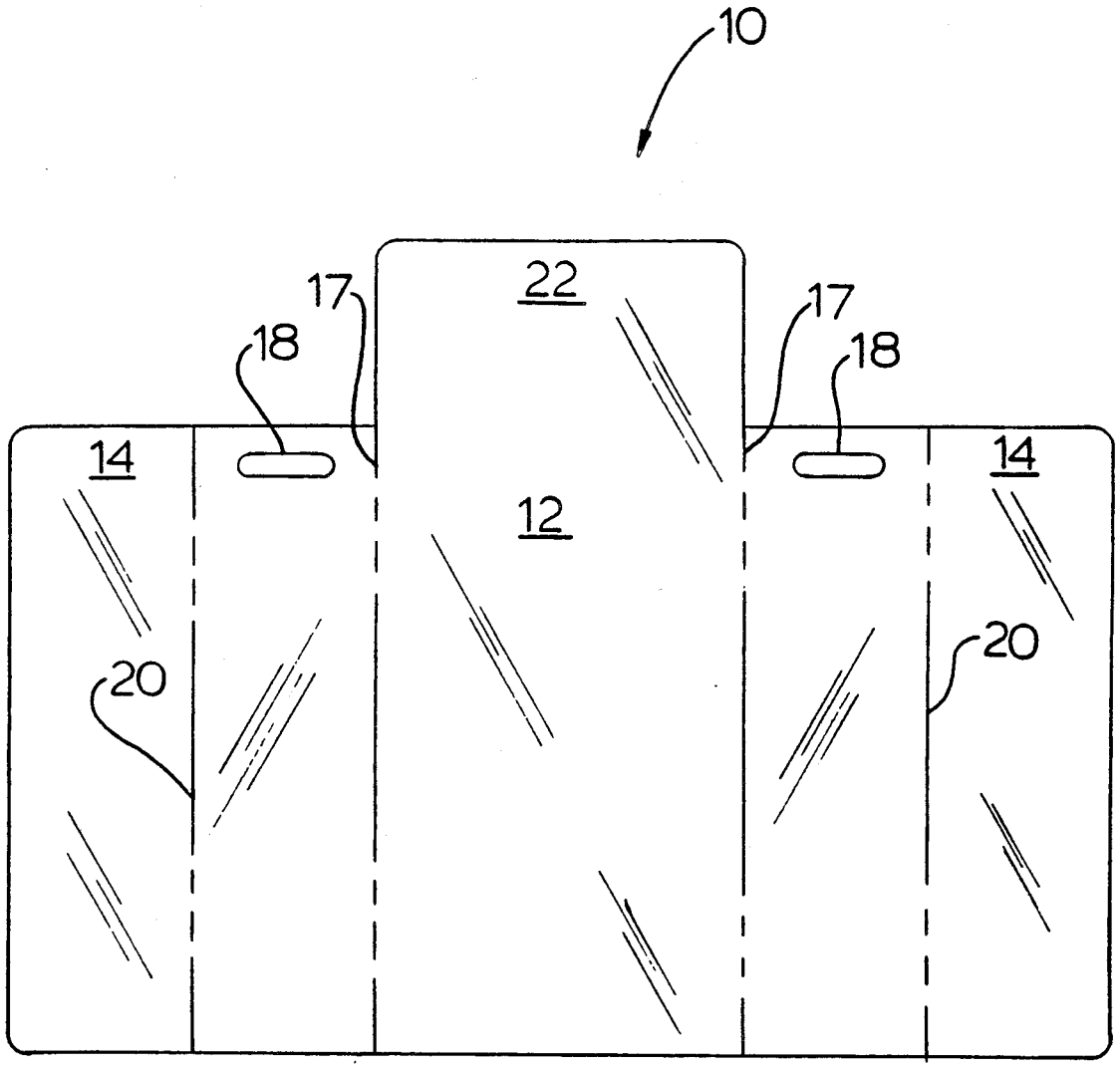
FIG. 4 is a front view showing the apparatus laid flat to more clearly illustrate its form.

FIG. 4 shows a frontal view of the support apparatus 10 as it would be cut from a form. In the preferred embodiment, the apparatus 10 is constructed of corrugated cardboard, commercially referred to as C-Flute 200 lb. The perforated cuts 20 would be made by any commercial process for making such cuts. Additionally, a cardboard construction allows the handle 18 to be "punched out" by hand.

Figure 5:
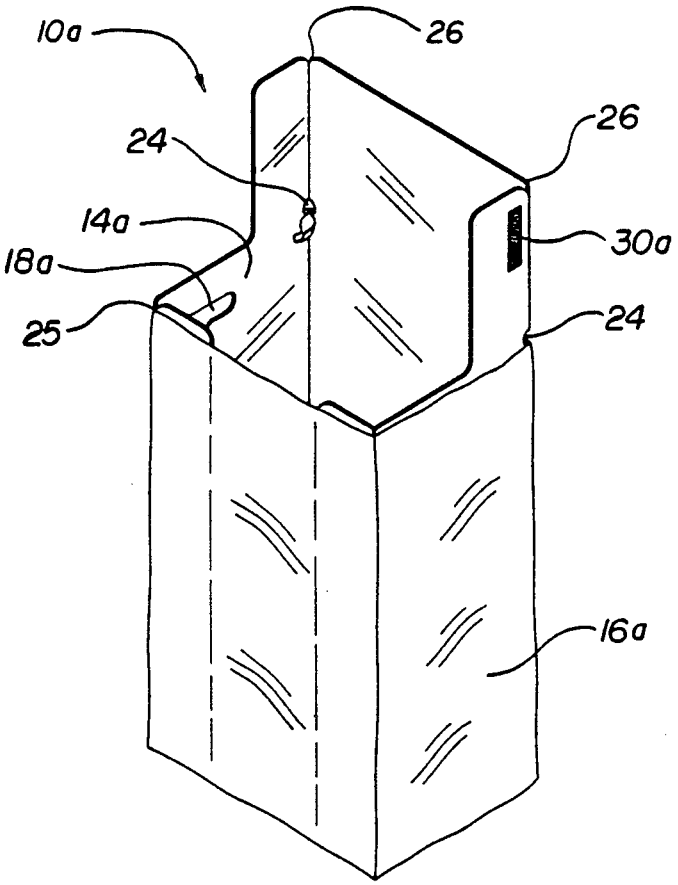
FIG. 5 is a perspective view showing an alternate embodiment of the support; apparatus with the bag outside the apparatus.
Figure 6:
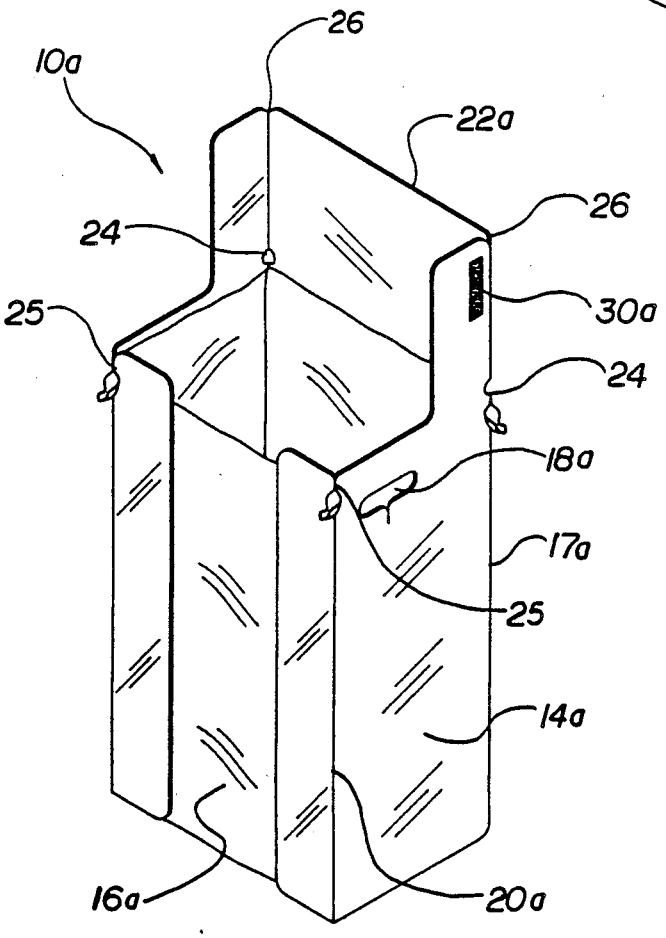
FIG. 6 is a perspective view showing the embodiment of FIG. 5 with the bag inside the apparatus and being held in the bag holding slots.

FIGS. 5 and 6 show an alternative embodiment of the present invention. This embodiment is designed to be used with plastic bags of various sizes, and especially with recycling bags. FIG. 5 shows the apparatus 10*a* placed inside the plastic bag 16*a* with a part of the plastic bag 16*a* pulled through one of the plastic bag holding slots 24. This holds the plastic bag 16 in place.

FIG. 6 shows the apparatus 10*a* with a plastic bag 16 on the inside of the apparatus 10*a*, supported thereby and held in place by parts of the bag threaded through the plastic bag holding slots 24 and 25. Additional plastic bag holding slots 26 are formed in the top edge of backboard 22*a* at the top of the perforated cut lines 17 as shown in FIG. 6, to allow larger bags to be held higher up. Also shown in FIGS. 5 and 6 are hook and loop fasteners 30 and 32 which allow multiple apparatus to be put together in adjoining relation for ease of sorting trash.

Figure 7:
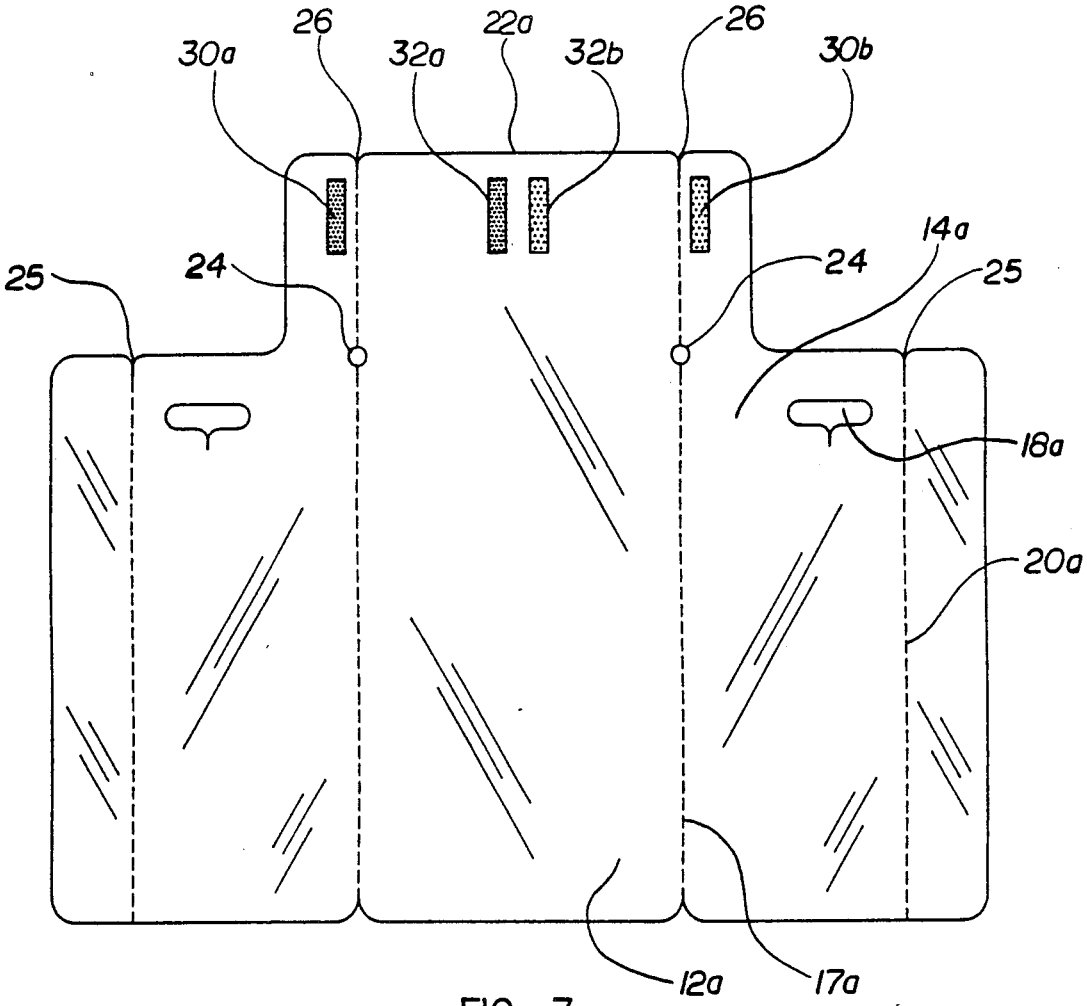
FIG. 7 is a front view of the embodiment of FIG. 5 showing the bag holding slots and the hook and loop fasteners.
Figure 8:
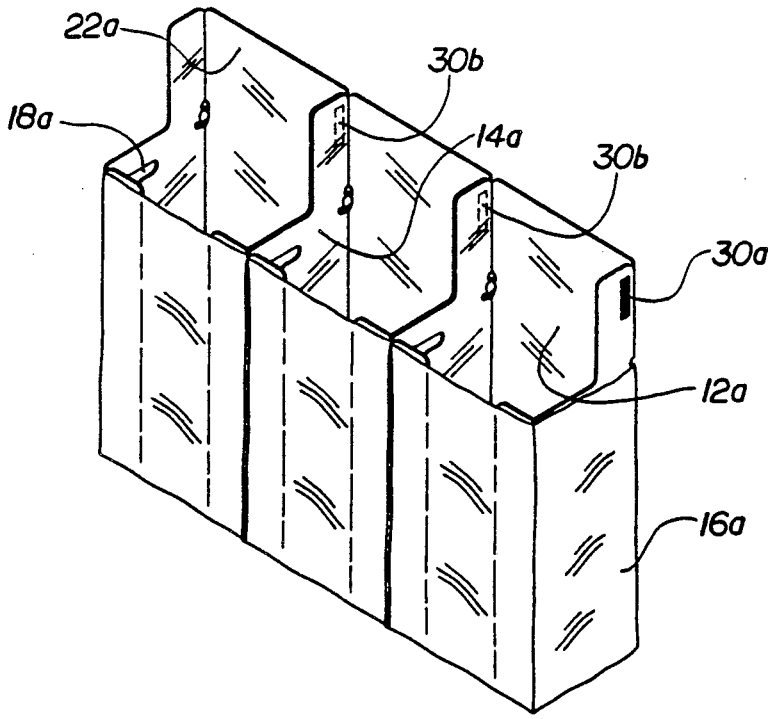
FIG. 8 is a perspective view of three support apparatus connected by the hook and loop fasteners in side by side aligned relation.

FIG. 7 shows the flat rear view of the apparatus, showing the various locations of the hook and loop fasteners 30*a* and 30*b*, 32*a* and 32*b*. The outer two hook and loop fasteners 30*a* and 30*b* are designed to engage similar hook and loop fasteners 30*a* and 30*b* on a different apparatus 10 of this type, as shown in FIG. 8. The middle hook and loop fasteners 32*a* and 32*b* are designed to perform similarly, and also may engage an adhesive backed wall strip with hook and loop fasteners attached thereto, which will be discussed later. Also shown are the plastic bag holding slots 24, 25 and 26 in the various locations, as discussed previously, and the location of the handles 18. In the preferred embodiment, the plastic bag holding slots 24 will be shaped like teardrops, with the tail end downwards, so that a part of the plastic bag 16 may be drawn through the body of the teardrop and then pulled downwards, thus frictionally securing the bag part into the plastic bag holding slot 24. Each slot 24 has a relatively wide and preferably rounded top and sides which converge downwardly to form a tail. The sides are preferably rounded as radius cuts.

Also shown in FIG. 7 are the perforated lines 17*a* between the back and side members 12 and 14, and the perforated lines 20*a* in the side members 14, which would be made in substantially the same way as discussed previously in connection with the first embodiment.

Figure 9:
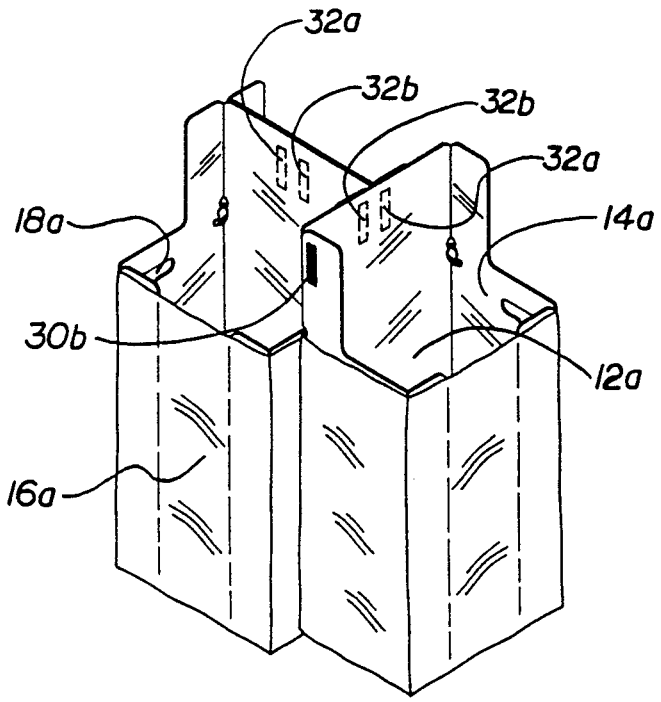
FIG. 9 is a perspective view of three support apparatus connected by the hook and loop fasteners in a different relation.

FIGS. 8 and 9 exhibit two possible ways to combine three apparatus using the hook and loop fasteners 30 and 32. FIG. 8 shows the three apparatus in side by side aligned relation, formed by attaching an outer hook and loop fasteners 30*a* and 30*b* to its counterpart on the adjacent apparatus while FIG. 9 shows another way of combining the three apparatus, two in back-to-back relation, the other with its back adjacent the sides of the first two, the combination being formed by aligning two apparatus in back-to-back relation, then attaching inner hook and loop fasteners 32*a* and 32*b* to their opposite counterparts, then attaching the third apparatus to the outer hook and loop fasteners 30*a* and 30*b* on the first two apparatus by aligning the hook and loop fasteners on its back 32*a* and 32*b* to the outer hook and loop fasteners 30*a* and 30*b* referred to earlier. This alignment is a good space saver, and works well in places such as apartments.

Figure 10:
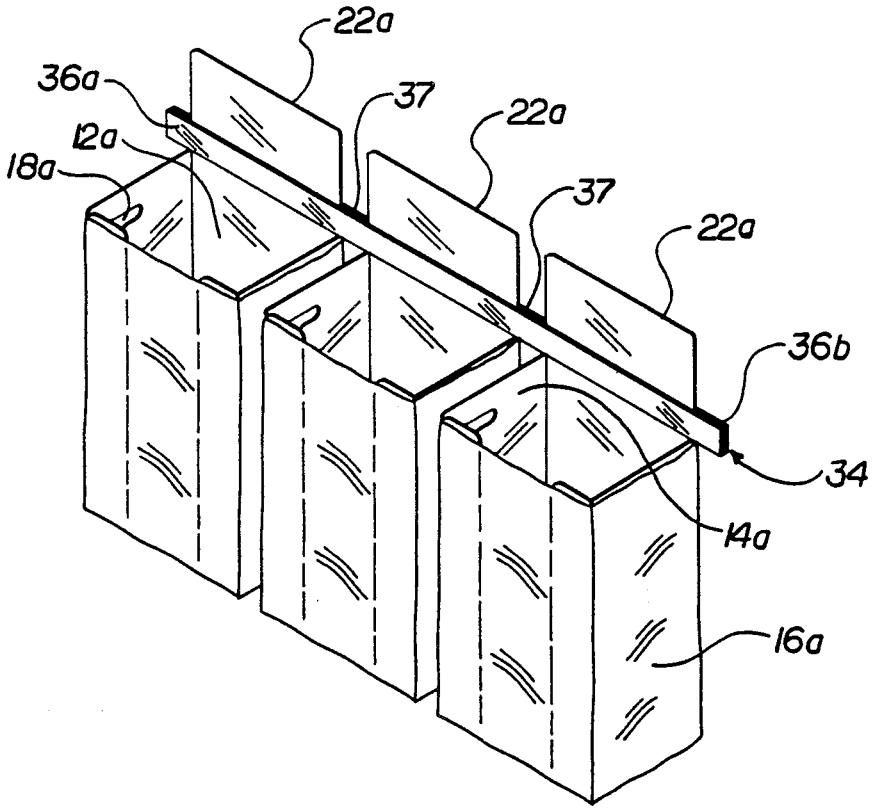
FIG. 10 is a perspective view of three support apparatus in side by side aligned relation as held there by an elongated cardboard connector channel.

FIG. 10 shows three apparatus held in side by side aligned relation by an elongated cardboard connector channel 34 which, in the preferred embodiment, is constructed of two strips 36*a* and 36*b* of cardboard, one in front of and adjacent with the aligned backs of the three apparatus and extending past the edges of the end apparatuses on either side, and the second behind and adjacent to the backs of the three apparatus, and of approximately the same length as strip 36*a*. The two strips 36*a* and 36*b* would be connected to each other at each end, leaving a gap between the strips slightly wider than the thickness of the backboards 22 of the apparatuses, thereby allowing the connector channel 34 to be placed over and on to the backboards 22 of the apparatuses, thus holding the apparatus in side by side aligned relation, as shown in FIG. 10. Spacer pads 37 may be adhered between the two strips 36*a* and 36*b* at positions between the three support apparatus 10*a*.

Figure 11:
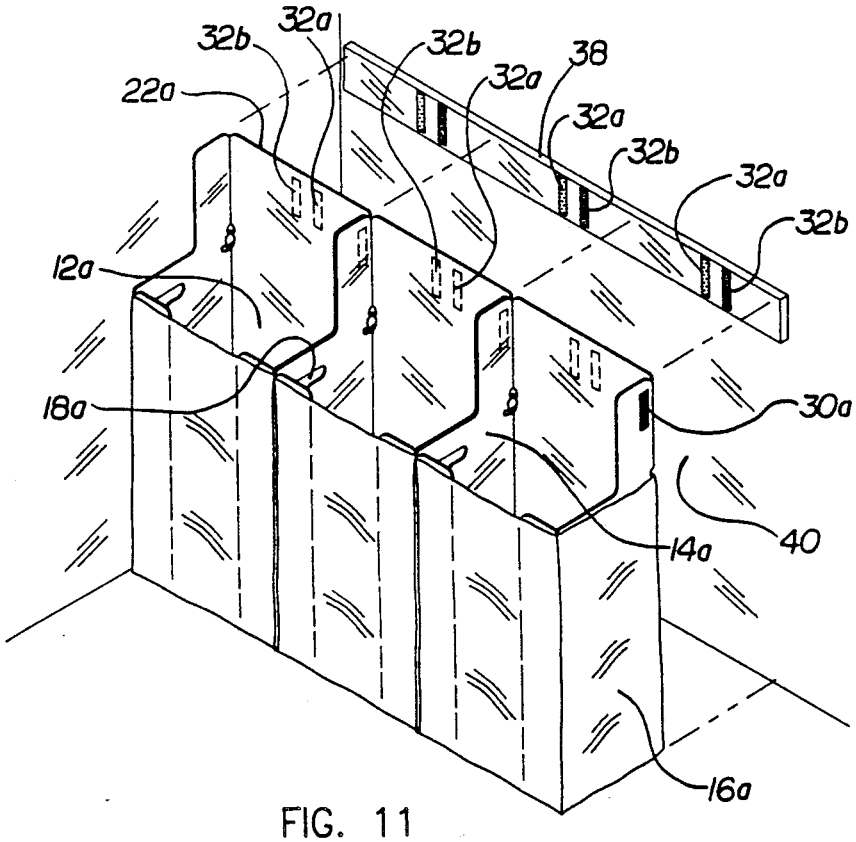
FIG. 11 is a perspective view of three support apparatus attached to an adhesive backed wall strip by a series of hook and loop fasteners.

Shown in FIG. 11 is an adhesive backed wall strip 38 with hook and loop fasteners 32 on the front, which, when fastened to a wall surface 40, will hold a plurality of apparatus against it by engaging the hook and loop fasteners 32*a* and 32*b* on the back 12 of each apparatus 10.

Figure 12:
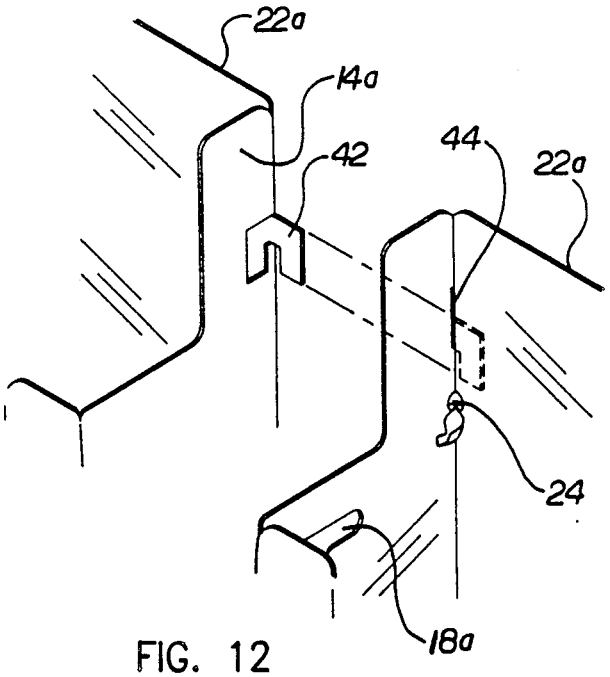
FIG. 12 is an enlarged perspective partial view of two support apparatus, one having a hook extending outward from the side, the other having a slot to receive the hook.
Figure 13:
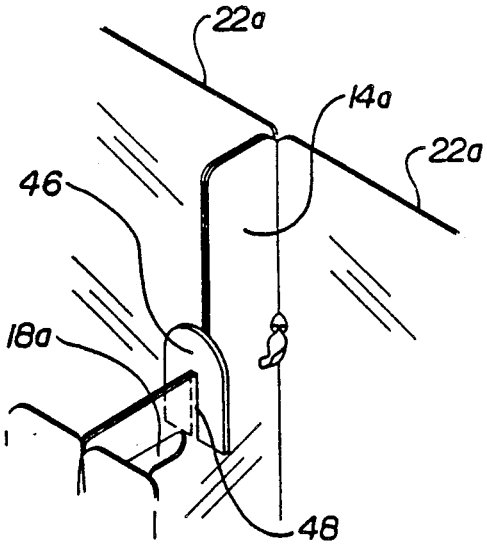
FIG. 13 is an enlarged perspective partial view of two apparatus in side by side aligned relation, showing the cardboard clip used to connect the two apparatus.

FIGS. 12 and 13 exhibit two alternative methods of securing two trash bag support apparatus to each other. FIG. 12 exhibits an integral hook 42 extending outwardly from a side member 14 which fits into an integral slot 44 cut into and opposite side member 14 of another apparatus. The slot 44 would preferably be set slightly above the opposite hook 42, such that when both apparatus were level and the hook 42 was set into and through the slot 44, the hook 42 could not be removed from the slot 44 without lifting the apparatus having the hook and then removing the hook 42. Thus, when engaged, the hook 42 and slot 44 combination would hold the apparatus together, much the same as the hook and loop fastener 30 and 32 combination.

FIG. 13 shows two apparatus in side-by-side configuration, and held there by a cardboard clip 46 in the preferred embodiment. The cardboard clip 46 is merely a rectangular piece of cardboard with a slot 48 cut approximately ½ of the length up into the clip 46 at the midpoint of a short side and parallel with the long sides, and of slightly greater width than the thickness of the two side members 14 when adjacent. The slot 48 on the clip 46 can be slid onto the adjacent side members 14, thus securing the two apparatus in adjacent relation Other methods of securing a plurality of apparatus to one another may be used, and the invention as claimed is not intended to be limited to the methods disclosed above.

Figure 14:
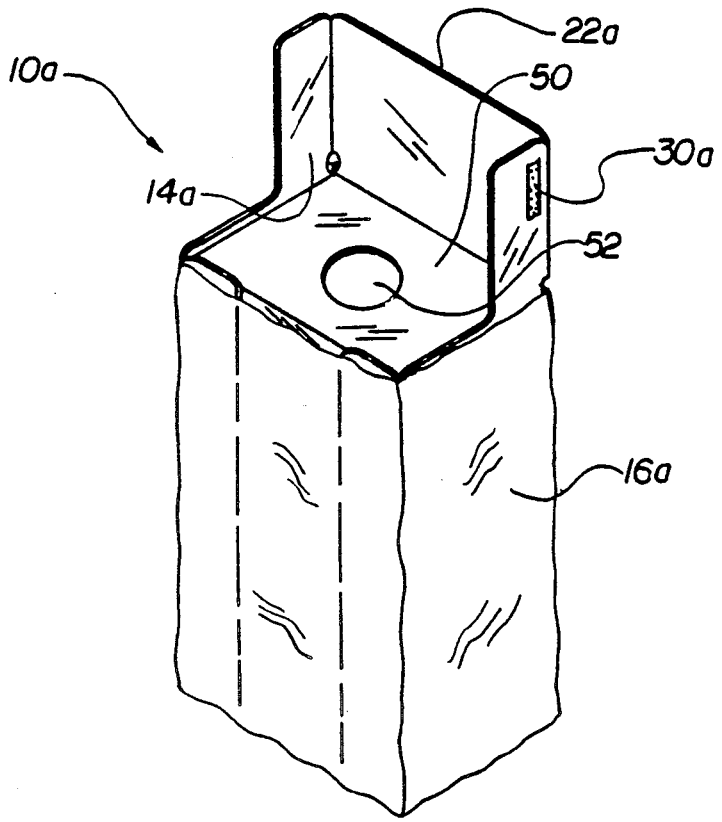
FIG. 14 is a perspective view of the support apparatus including an optional, top cover with an opening to receive refuse.
Figure 15:
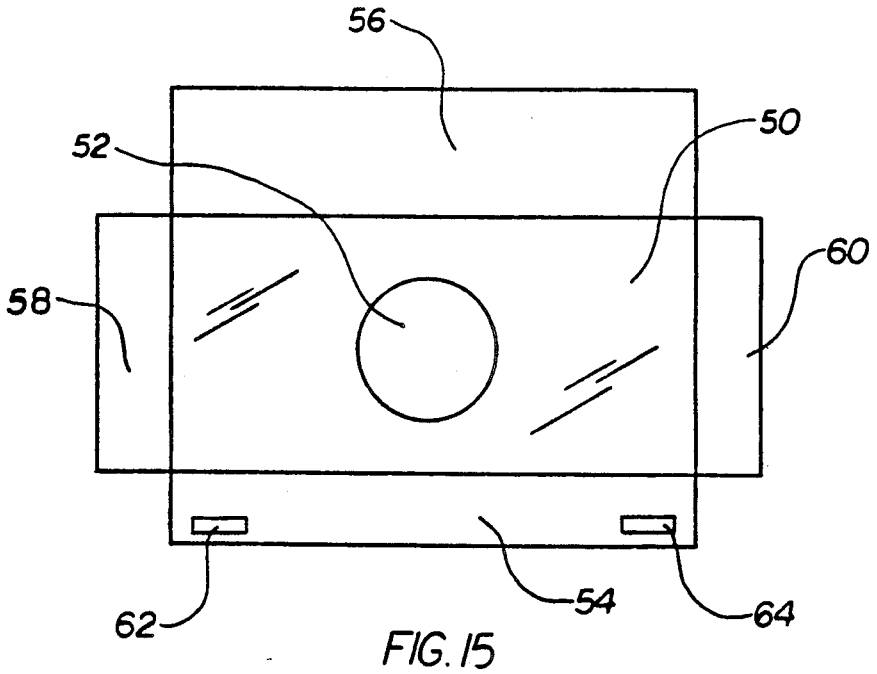
FIG. 15 is a top plan view of a cardboard blank for the top cover with a circular opening to accommodate used beverage containers.
Figure 16:
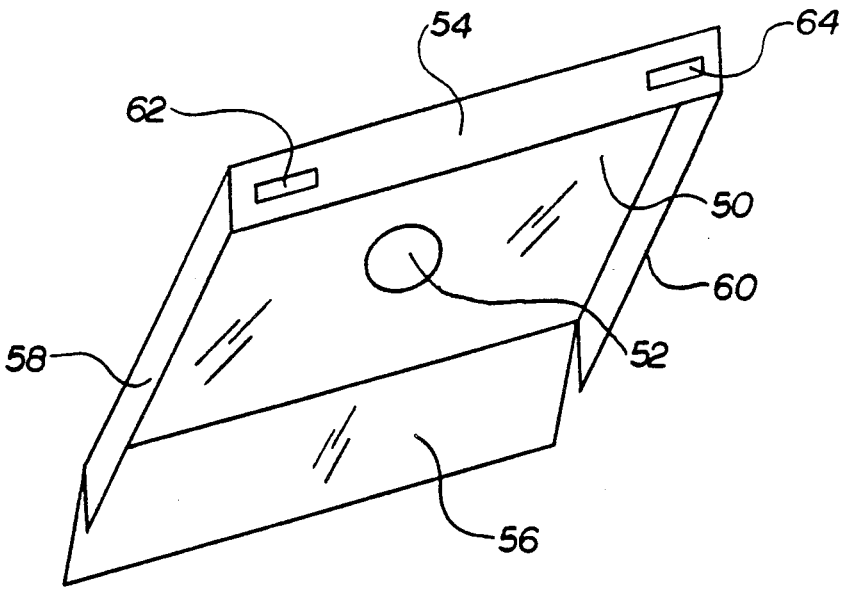
FIG. 16 is a bottom perspective view of the top cover with the sides folded into its installed position.
Figure 17:
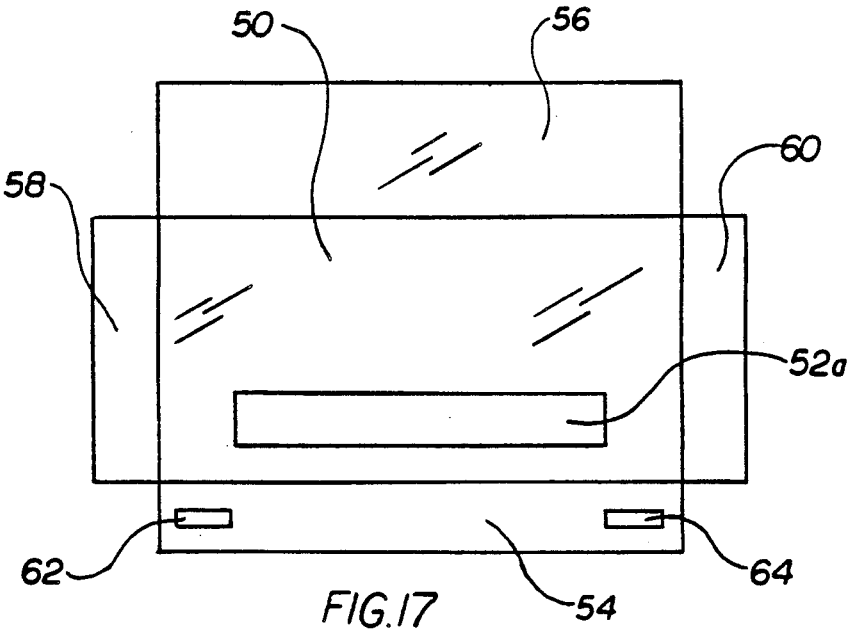
FIG. 17 is a top plan view of a cardboard blank for an alternate top cover with an elongated rectangular opening to accommodate recyclable flat paper.

FIG. 14 illustrates a support apparatus 10*a* which additionally includes a generally flat top cover 50 having an opening 52 through it for receipt of refuse into a bag supported on the apparatus. To secure top cover 50 in place over the open top of the upper section of the apparatus, the top cover has front, back and opposite side flanges 54, 56 and 58 and 60 depending from front, back and opposite side edges thereof. The back flange 56 may be of greater vertical extent in the installed position indicated in FIG. 16 to afford greater surface contact with back 12*a*. The flange may be secured thereto by a double adhesive strip, adhesive, hook and loop fasteners or any other suitable fastening means. Disengagable hook and loop fasteners 62 and 64 may be adhered to opposite end of front flange 54 and to side members 14*a* on the interior surface thereof adjacent the top outer corner, both for supporting the top cover 50 and reinforcing the side members 14*a*. Whereas the opening 52 is shown as being circular in FIGS. 14, 15 and 16 to designate the apparatus 1? a for receipt of used beverage containers, it could alternately be of an elongated rectangular shape as indicated at 52*a* in FIG. 17 to designate the apparatus for receipt of recyclable sheet paper. Various other shapes of openings could be substituted as well.

Whereas specific dimensions are not critical to the present invention, it is contemplated that most all plastic bags having a capacity of between approximately 13 gallons and 39 or more gallons can be accommodated by providing the support apparatus in heights of 20", 31", 39" and 45". While accommodating very large bags, the 45" model will nevertheless easily fit within even a compact car.

Other dimensions for the various models may be uniform. For example, the back may be 13½" wide with each side member being approximately 12½" wide including an approximately 3½" outermost section outwardly of the perforated fold line therein.

Lastly, it should be noted that in a preferred embodiment the bottom ½ to ⅔ of the flexible trash bag support apparatus would be covered with a liquid resistant coating, such as MICHEM COAT 40 SERIES produced by Michelman, Inc., Cincinnati, Ohio. This coating greatly increases the useful life of the apparatus and results in greater savings for consumers, and thus could be utilized in a preferred embodiment.

Whereas the invention has been shown and described in connection with a preferred embodiment thereof, it is apparent that many modifications, additions and substitutions may be made which are within the intended broad scope of the appended claims. For example, whereas the various fold lines are described as a series of perforations, they could alternately be formed as compressed lines or lines of reduced wall thickness. Also, whereas the support apparatus is described as being formed of corrugated cardboard; it could alternately be constructed of corrugated plastic or plastic sheet stock of polypropylene, for example, that can be die cut, scored and perforated.

An advantage of the support apparatus of the invention is that both the front and back surfaces of the rigid back and side members as well, afford ample space to display advertising or to display motivational messages such as to promote and instruct viewers to recycle waste.

I claim:

1. Apparatus for supporting flexible trash bags for receiving refuse comprising:

a substantially flat rigid back having top, bottom, and opposite side edges;

two side members, each side member having a substantially flat surface;

each side member having top, bottom and inner and outer side edges, an inner side edge of each side member being pivotally connected to a respective one of said opposite side edges of said back such that upon insertion into a flexible trash bag, said side members may be pivoted outwardly from said back to the limit of said flexible trash bag;

plastic bag holding slots arranged in an upper section of said apparatus whereby a piece of a flexible trash bag may be passed therethrough and held, thereby securing said bag in place and said plastic bag holding slots further comprising teardrop shaped holes having a relatively wide top and sides converging downwardly to form a tail, said holes extending through any of said back or side walls, whereby a section of plastic bag may be passed therethrough and drawn downwards into the tail of the teardrop, thus holding said bag in place.

2. The apparatus of claim 1 wherein the substantially flat rigid back extends above at least a portion of the top edges of the side members to form a backboard against which refuse may be tossed for placement in a trash bag supported by the apparatus.

3. The apparatus of claim 2 wherein said side members each having at least one line of perforations running its upright length, whereby a plastic bag will assume a substantially rectangular box shape when placed inside of or around said apparatus.

4. The apparatus of claim 1 wherein said teardrop shaped holes are positioned in each of the corners of said apparatus when said apparatus is in bag holding position and the holes adjacent said back member are at substantially the same height as the frontmost slots.

5. The apparatus of claim 1 further comprising a generally flat top cover, means for securing said top cover relative to said back and side members to substantially cover the open top of the apparatus, said cover having an opening for receipt of refuse into a bag supported on said apparatus.

6. The apparatus of claim 5 wherein said top cover has front, back and opposite side edges, said means for securing said top cover relative to said back and side members comprising flanges depending from a plurality of said edges of the top cover and means for securing said flanges to the adjacent back or side member.

7. The apparatus of claim 6 wherein said opening is circular to designate said apparatus for receipt of used beverage containers.

8. The apparatus of claim 6 wherein said opening is rectangular to designate said apparatus for receipt of recyclable paper.

9. The apparatus of claim 3 wherein said back and side members are constructed of a corrugated material.

10. The apparatus of claim 9 wherein said back and side members are coated with a waterproof material.

11. The apparatus of claim 10 wherein said side members have handles operatively associated therewith.

12. Apparatus for supporting flexible trash bags for receiving refuse comprising:

a substantially flat rigid back having top, bottom, and opposite side edges;

each side member having top, bottom and inner and outer side edges, an inner side edge of each side member being pivotally connected to a respective one of said opposite side edges of said back such that upon insertion into a flexible trash bag, said side members may be pivoted outwardly from said back to the limit of said flexible trash bag; and means for connecting two or more of said apparatus whereby two or more apparatus may be joined together in side-by-side or back-to-back configuration thereby allowing multiple flexible trash bag use, as in recycling and said means for connecting two or more of said apparatus further comprising an elongated cardboard connector channel comprising a pair of parallel cardboard strips, whereby two or more apparatus placed in side by side aligned relation may have a cardboard connector channel placed over said backs, one strip in front of said backs, one strip behind, thereby holding a securing said apparatus in side by side aligned relation.

13. Apparatus for supporting flexible trash bags for receiving refuse comprising:

a substantially flat rigid back having top, bottom, and opposite side edges;

two side members, each side member having a substantially flat surface;

each side member having top, bottom and inner and outer side edges, an inner side edge of each side member being pivotally connected to a respective one of said opposite side edges of said back such that upon insertion into a flexible trash bag, said side members may be pivoted outwardly from said back to the limit of said flexible trash bag;

plastic bag holding slots arranged in an upper section of said apparatus whereby a piece of a flexible trash bag may be passed therethrough and held, thereby securing said bag in place; and in combination, holes extending through any of said back or side walls and slots depending downwardly from each of said holes, whereby a section of plastic bag may be passed therethrough and drawn downwards into said slot, thereby securing a bag in place.

14. Apparatus for supporting flexible trash bags for receiving refuse comprising:

a substantially flat rigid back having top, bottom, and opposite side edges;

two side members, each side member having a substantially flat surface;

each side member having top, bottom and inner and outer side edges, an inner side edge of each side member being pivotally connected to a respective one of said opposite side edges of said back such that upon insertion into a flexible trash bag, said side members may be pivoted outwardly from said back to the limit of said flexible trash bag;

said substantially flat rigid back extending above said outer side edges of each of said side members to form a backboard against which refuse may be tossed for placement in a trash bag supported by said apparatus; and said side members further comprising vertical extensions along said inner side edges such that said inner sides edges are substantially longer than said outer side edges and approximately the same length as said side edges of said flat back, and said vertical extensions being pivotally connected to said backboard whereby said apparatus is made more stable.

15. The apparatus of claim 14 further comprising means for connecting two or more of said apparatus whereby two or more apparatus may be joined together in side-by-side or back-to-back configuration thereby allowing multiple flexible trash bag use, as in recycling.

16. The apparatus of claim 15 wherein said means for connecting two or more of said apparatus further comprises coating hook and loop fasteners attacked to an exterior surface of said rigid back, and positioned such that when two apparatus are placed in adjoining back to back relation, the fasteners on the adjacent backs are engaged, thus holding and securing said two apparatus in adjoining relation.

17. The apparatus of claim 16 wherein said fasteners are so positioned that the fasteners on the side members of a pair of apparatus in adjoining back to back relation may be aligned with the fasteners on the rigid back of a third apparatus for securement of the three apparatus in adjoining relation.

18. The apparatus of claim 15 wherein said means for connecting two of said apparatus further comprises an integral slot and hook fastening means including a slot, an integral hook foldable relative to one apparatus so as to extend therefrom for receipt in the slot of a second apparatus, when said two apparatus are in adjoining relation, thereby holding and securing said two apparatus in adjoining relation.

19. The apparatus of claim 15 wherein said means for connecting two or more of said apparatus further comprises coacting hook and loop fasteners, one of said fasteners being attached to an exterior surface of each side member, and positioned such that when two apparatus are placed in adjoining side by side relation, the fasteners on the adjacent side members will join, thus holding and securing said two apparatus in adjoining relation.

20. The apparatus of claim 15 wherein said means for connecting two or more of said apparatus further comprises a cardboard clip having a slot therein, whereby two apparatus in adjoining relation may be held together by placement of said clip onto said apparatus with adjoining surfaces of said apparatus engaged within said slot.

21. The apparatus of claim 14 further comprising plastic bag holding slots arranged in an upper section of said apparatus whereby a piece of a flexible trash bag may be passed therethrough and held, thereby securing said bag in place.

22. The apparatus of claim 19 further comprising a wall strip having front and back surfaces, hook and loop fasteners on the front surface and means for securing said back surface to a wall, whereby said strip is operative to secure at least one apparatus relative to a wall.

23. The apparatus of claim 14 wherein the lower end of each opposite side edge of the rigid back and the lower end of each of said inner and outer edges of said side members are rounded to facilitate entry of the apparatus into a plastic bag without tearing.

* * * * *